US010054877B2

(12) United States Patent
Mizukoshi et al.

(10) Patent No.: US 10,054,877 B2
(45) Date of Patent: Aug. 21, 2018

(54) DEVELOPING APPARATUS HAVING VARYING MAGNETIC FLUX DENSITY AND IMAGE FORMING APPARATUS

(71) Applicant: CANON KABUSHIKI KAISHA, Tokyo (JP)

(72) Inventors: Shunsuke Mizukoshi, Yokohama (JP); Takayuki Namiki, Yokohama (JP); Yuta Isobe, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/618,423

(22) Filed: Jun. 9, 2017

(65) Prior Publication Data

US 2017/0357189 A1 Dec. 14, 2017

(30) Foreign Application Priority Data

Jun. 14, 2016 (JP) ..... 2016-118241
May 17, 2017 (JP) ..... 2017-098292

(51) Int. Cl.
*G03G 15/09* (2006.01)
*G03G 15/08* (2006.01)

(52) U.S. Cl.
CPC ..... *G03G 15/0942* (2013.01); *G03G 15/0812* (2013.01); *G03G 15/0817* (2013.01)

(58) Field of Classification Search
CPC ..... G03G 15/0942; G03G 15/0812
USPC ..... 399/106
See application file for complete search history.

(56) References Cited

U.S. PATENT DOCUMENTS 5,187,326 A * 2/1993 Shirai ..... G03G 15/0898 399/104
6,151,467 A * 11/2000 Yamaguchi ..... G03G 15/0942 399/104
7,444,092 B2 10/2008 Naito et al.
8,687,987 B2 4/2014 Yano et al.

FOREIGN PATENT DOCUMENTS

JP H05-307321 A 11/1993
JP 2014-122983 A 7/2014

* cited by examiner

*Primary Examiner* — Billy Lactaoen
(74) *Attorney, Agent, or Firm* — Fitzpatrick, Cella, Harper & Scinto

(57) ABSTRACT

At an end, in a longitudinal direction, of an opening in a container containing a magnetic developer, an overlap portion is provided in which a developer bearing member, a regulating member, a sealing member, and the container are arranged so as to sequentially contact one another in a direction orthogonal to a rotation axis direction. A magnetic field generating member provided inside the developer bearing member has a first area where a value of a magnetic flux density is a predetermined value in the rotation axis direction and a second area including a local minimum portion in which the value is a minimum value, within a range from an end of the second area connected to the first area to an outer end of the overlap portion in the rotation axis direction.

20 Claims, 10 Drawing Sheets

DEVELOPING APPARATUS HAVING VARYING MAGNETIC FLUX DENSITY AND IMAGE FORMING APPARATUS

BACKGROUND OF THE INVENTION

Field of the Invention

The present invention relates to an image forming apparatus using an electrophotographic system.

Description of the Related Art

For image forming apparatuses such as copiers and printers which use an electrostatic recording system, an electrophotographic system or the like, some of these image forming apparatuses are configured such that a magnetic toner is carried on a surface of a developing sleeve internally provided with a magnet roller and that the amount of toner is regulated using an elastic regulating blade. In this case, excessive regulation of the amount of toner leads to the lack of toner on the developing sleeve, resulting in an excessively low density. Thus, what is called a face contact configuration is generally used in which, in an image forming area, the middle of the regulating blade is brought into contact with the developing sleeve with a tip of the regulating blade used as a free end so as to form a toner take-in portion. In that case, a larger amount of toner can be fed onto the developing sleeve by increasing the length from the contact portion between the regulating blade and the developing sleeve to the tip of the regulating blade to enlarge the take-in portion.

In a known configuration of a developing unit (developing apparatus) including a developer bearing member, toner is trapped by sealing members provided at longitudinal ends of the developing unit and formed of magnets so that the toner is prevented from leaking through gaps between members. However, the sealing members formed of magnets are expensive, and thus, a more inexpensive sealing technique is widely used that involves elastic sealing members including a substrate formed of a blowing member such as sponge and a fibrous material such as felt or Teflon pile provided on a surface of the substrate. In this regard, what is called a butting configuration is widely known in which a side surface of the regulating blade is compressed against a side surface of each of the elastic sealing members to close the gap. However, to achieve the compression between the regulating blade and each elastic sealing member, a member allowing the elastic member to be externally pushed needs to be provided, leading to a complicated configuration. In contrast, what is called an overlap configuration of the regulating blade is widely known in which surfaces of the elastic sealing members contact a surface of the regulating blade that is opposite to a surface thereof contacting the developing sleeve. However, if the amount of toner supplied is increased by enlarging the take-in portion as described above, the overlap configuration may fail to adequately trap toner flowing at any time into the elastic sealing members through the gap between the regulating blade and the developing sleeve. As a result, the toner may leak.

In contrast, a developing apparatus is known in which tips of the regulating blade are formed to bend progressively backward at longitudinally opposite ends so as to bring the regulating blade into edge contact with the developing sleeve at the longitudinally opposite ends (Japanese Patent Application Laid-open No. H5-307321). Furthermore, a method is known that uses a magnetic contact developing system such that ends of a magnetic field generating area are provided inward of the sealing members in order to reduce the amount of toner flowing between each elastic sealing member and the developing sleeve (Japanese Patent Application Laid-open No. 2014-122983).

However, the use of the conventional developing apparatuses poses the following problems. For example, when the regulating blade is brought into edge contact the developing sleeve, the contact area between the regulating blade and the developing sleeve is smaller than when the middle of the regulating blade contacts the developing sleeve. Thus, in this case, a contact pressure is increased that is exerted between the regulating blade and the developing sleeve per unit area. Furthermore, in the area where the regulating blade and the elastic sealing member overlap, the regulating blade is pushed by the elastic sealing member. This increases the contact pressure between the regulating blade and the developing sleeve. Thus, when the regulating blade is brought into edge contact with the developing sleeve in the area where the regulating blade and each elastic sealing member overlap, an excessive contact pressure is exerted between the regulating blade and the developing sleeve. Consequently, the toner may stick between the regulating blade and the developing sleeve to form a gap between the regulating blade and the developing sleeve, resulting in toner leakage.

When the tip of the regulating blade is formed to bend backward in order to reduce the size of the take-in portion, that portion of the toner accumulated on the surface of the developing sleeve which adheres more firmly to the developing sleeve is likely to be selectively carried by the regulating blade. This is more significant at the longitudinal ends where circulation is insufficient. In contrast, when the tip of the regulating blade is bent backward so as to bring the regulating blade into edge contact with the developing sleeve as in Japanese Patent Application Laid-open No. H5-307321, the toner on the developing sleeve can be stripped away. However, if, even for the portion of the regulating blade in which the tip is bent backward, the middle of the regulating blade is brought into contact with the developing sleeve, the toner fails to be adequately stripped away. Thus, the toner on the developing sleeve may stick, leading to leakage of the toner.

Moreover, the method in which the ends of the magnetic field generating area are arranged inward of the sealing members is not preferable for a magnetic non-contact developing system. This is because, when the ends of the magnetic field generating area are provided inward of the sealing members, a development pole located opposite to a photosensitive drum at the longitudinal ends has a reduced magnetic force, resulting in reduced force to hold the toner on the developing sleeve. In that case, the magnetic non-contact developing system may involve fly of the toner from the developing sleeve to the photosensitive drum, that is, fogging, as described in Japanese Patent Application Laid-open No. 2014-122983.

An object of the present invention is to provide a technique that allows suppression of sticking and leakage of a developer at longitudinal direction ends of a developing unit.

SUMMARY OF THE INVENTION

In order to achieve the above object, the developing apparatus of the present invention is a developing apparatus comprising: a container containing a magnetic developer and having an opening through which the magnetic developer is fed; a developer bearing member provided in the container so as to be rotatable in the opening and configured to carry the magnetic developer; a magnetic field generating member provided inside the developer bearing member to generate a predetermined magnetic field; a regulating member configured to contact the developer bearing member to regulate a layer thickness of the magnetic developer carried on the developer bearing member; and a sealing member configured to seal a gap between an end of the developer bearing member in a rotation axis direction and an end of the opening in a longitudinal direction, wherein, at the end of the opening in the longitudinal direction, an overlap portion is provided in which the developer bearing member, the regulating member, the sealing member, and the container are sequentially arranged so as to contact one another in a direction orthogonal to the rotation axis direction, and the magnetic field generating member has a first area where a value of a magnetic flux density is a predetermined value in the rotation axis direction and a second area including a local minimum portion in which the value is a minimum value, within a range from an end of the second area connected to the first area to an outer end of the overlap portion in the rotation axis direction.

In order to achieve the above object, the image forming apparatus of the present invention is an image forming apparatus comprising: an image bearing member configured to bear a latent image; and the developing apparatus, wherein the developing apparatus develops the latent image to transfer a developer image formed on the image bearing member to a recording material thereby forming an image on the recording material.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments(examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

The present invention relates to a developing apparatus, a developing cartridge, a process cartridge, and an image forming apparatus including the developing apparatus, the developing cartridge, and the process cartridge. The developing apparatus has a developing sleeve internally provided with a magnet roller and serving as a developer bearing member bearing a developer on a surface of the developing sleeve. The developing apparatus uses the developing sleeve to visualize an electrostatic image (static image) formed on a photosensitive drum (image bearing member) using a developer. The developing cartridge is an integral unit including the developing apparatus and removably installed in an image forming apparatus main body. The process cartridge is an integral unit that includes the photosensitive drum and the developing apparatus acting on the photosensitive drum and that is removably installed in the image forming apparatus main body. The image forming apparatus forms images on recording media (recording materials) such as sheet materials using an electrophotographic image forming system. Examples of image forming apparatuses to which the present invention is applicable include electrophotographic copiers, electrophotographic printers (LED printers, laser printers, and the like), facsimile machines, and word processors.

(Configuration of the Image Forming Apparatus)

Figure 2:
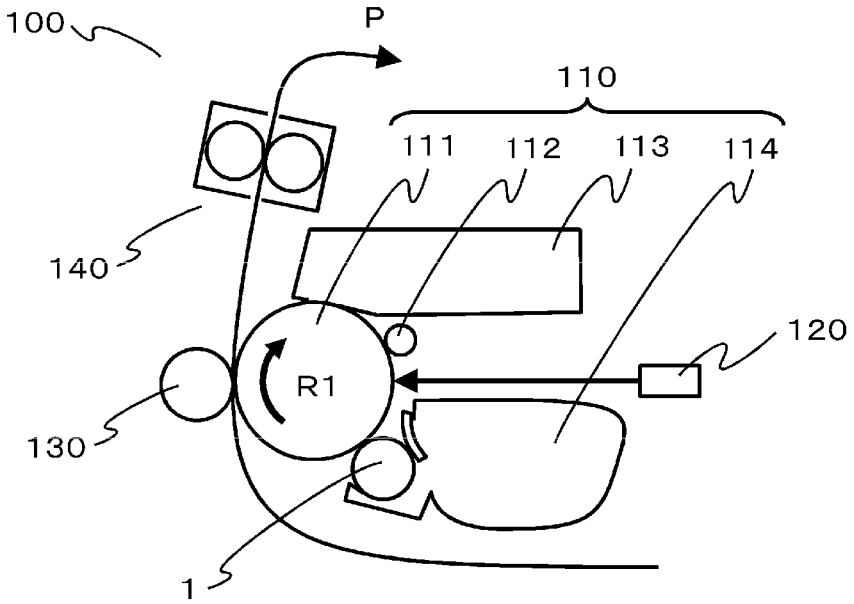
FIG. 2 is a schematic sectional view depicting a configuration of an image forming apparatus according to Embodiment 1.

Using FIG. 2, descriptions will be given that relate to a configuration of an image forming apparatus 100 in Embodiment 1 and an image forming process in Embodiment 1. FIG. 2 is a schematic sectional view depicting a general configuration of the image forming apparatus 100 in Embodiment 1.

The image forming apparatus 100 includes a process cartridge 110 in which a photosensitive drum 111 (image bearing member), a charging roller 112 (charging means), a cleaning unit 113, and a developing unit 114 are integrated together; the process cartridge 110 is removably installed in the apparatus main body. The apparatus main body with the process cartridge 110 installed therein performs a part of an image forming operation. In this case, the apparatus main body is the apparatus configuration of the image forming apparatus except for the process cartridge 100.

While rotating in the direction of arrow R1, the photosensitive drum 111 is uniformly charged to a predetermined polarity and a predetermined potential by the charging roller 112. A laser beam emitted from an exposure unit 120 impinges on the photosensitive drum 111 to form an electrostatic image. A developing sleeve 1 (developer bearing member) provided on the developing unit 114 is located in proximity to the photosensitive drum 111 with a predetermined clearance between the developing sleeve 1 and the photosensitive drum 111. A developing bias is generated between the developing sleeve 1 and the photosensitive drum 111 by a bias applying power supply not depicted in the drawings. The developing bias allows toner to migrate from the developing sleeve 1 to the surface of the photosensitive drum 111 to visualize the electrostatic image, forming a toner image (developer image). A transfer roller 130 includes a conductive cored bar and a urethane blowing layer and contacts the photosensitive drum 111 while no recording material P is present between the transfer roller 130 and the photosensitive drum 111. The toner image formed on the photosensitive drum 111 is transferred onto the recording material P by the bias applied to the transfer roller 130. The toner image transferred onto the recording material P is pressurized and heated by a fixation unit 140 and thus fixed to the recording material P as a final image. That portion of the toner image formed on the photosensitive drum 111 which remains on the recording material P rather than being transferred is conveyed to the cleaning unit 113, which strips the toner away from the surface of the photosensitive drum 111.

(Configuration of the Developing Unit)

Figure 3:
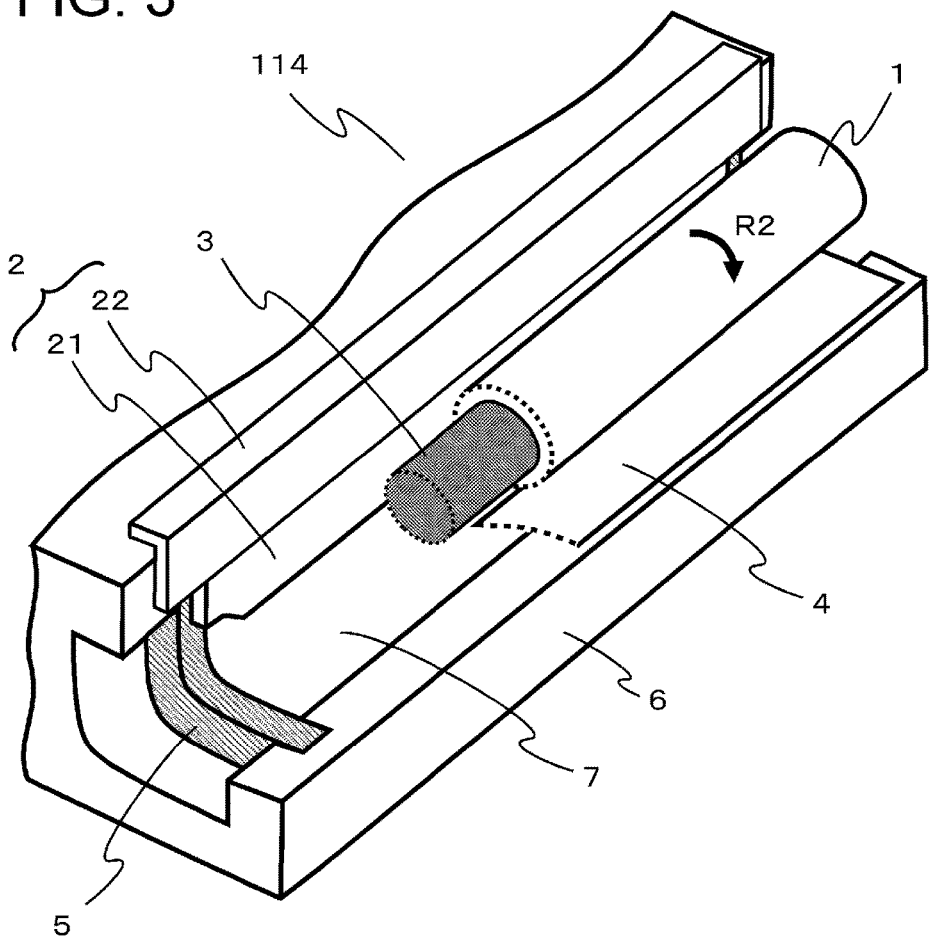
FIG. 3 is a schematic perspective view depicting a configuration of the developing unit according to Embodiment 1.

Using FIGS. 3, 4, and 5, a configuration of the developing unit 114 serving as a developing apparatus in Embodiment 1 will be described. FIG. 3 is a schematic perspective view depicting the configuration of the developing unit 114 in Embodiment 1. In FIG. 3, some members positioned on a surface are expressed in a partially exploded view in order to describe arrangement of the members. As depicted in FIG. 3, the developing unit 114 includes the developing sleeve 1 (developer bearing member), a regulating blade 2, a magnet roller 3 (magnetic field generating member), a blow-off preventing sheet 4, end seals 5 (sealing members), and a frame 6 (developer container). The developing sleeve 1 and the magnet roller 3 are coaxial. The term "axial" as used herein means an axial direction of the developing sleeve 1 and the magnet roller 3 unless otherwise specified.

The developing sleeve 1 is a hollow aluminum cylinder coated with a resin layer containing conductive particles and is arranged to be powered through a drive gear not depicted in the drawings so as to be rotatable in the direction of arrow R2. The regulating blade 2 includes a flat rubber plate 21 having fine recesses and protrusions on a surface of the flat rubber plate 21 and an SUS sheet 22. The flat rubber plate 21 has a cantilever configuration in which the flat rubber plate 21 is supported at one end thereof by the SUS sheet 22 in a direction orthogonal to the axial direction. A free-end surface of the flat rubber plate 21 is brought into contact with the developing sleeve 1 to regulate the amount of toner on the developing sleeve 1 to a substantially constant value. The SUS sheet 22 is assembled to the frame 6 via screws not depicted in the drawings. The magnet roller 3 is a roller fixedly attached to the developing unit 114 and formed of a magnet. The magnet roller 3 is arranged inside the developing sleeve 1 to generate magnetic fields that allow toner to be carried on a surface of the developing sleeve 1.

The blow-off preventing sheet 4 is a flexible sheet member that closely contacts the developing sleeve 1 to prevent toner from leaking from the frame 6. The end seals 5 are elastic members each having a contact surface that contacts the developing sleeve 1 and that is provided with fine bristles. The end seals 5 closely contact the developing sleeve 1, the regulating blade 2, the blow-off preventing sheet 4, and the frame 6 to prevent toner from leaking from the frame 6 through axially opposite ends thereof. Magnetic toner is contained in the frame 6 and fed to the developing sleeve 1 in a developing opening 7 partitioned by the regulating blade 2, the blow-off preventing sheet 4, and the end seals 5. In FIG. 3, an area located inward of the developing opening 7 serving as an opening serves as a housing unit for toner in the frame 6 serving as a developer container.

That is, the blow-off preventing sheet 4 and the end seals 5 are sealing members that allow only a portion of the toner regulated by the regulating blade 2 and carried on the developing sleeve 1 to be migrated from inside to outside of the frame 6 via the developing opening 7. The regulating blade 2 is arranged between a peripheral surface of the developing sleeve 1 arranged rotatably in the developing opening 7 and the frame 6, to regulate, to a predetermined thickness, the layer thickness of the toner carried on the peripheral surface of the developing sleeve 1 and migrated through the developing opening 7 to the outside of the frame 6. The blow-off preventing sheet 4 is arranged between the peripheral surface of the developing sleeve 1 and the frame 6 and opposite to an area where the regulating blade 2 is arranged. The blow-off preventing sheet 4 prevents toner from leaking to the outside of the frame 6 through a gap between the peripheral surface and the frame 6. The end seals 5 are provided at respective axially opposite ends of the developing sleeve 1 to prevent toner from leaking to the outside of the frame 6 through gaps between the developing sleeve 1 and the frame 6 and the regulating blade 2. At longitudinal (axial) ends of the developing opening 7 in the frame 6 where the end seals 5 are arranged, overlap portions are formed in which the developing sleeve 1, the regulating blade 2, the end seal 5, and the frame 6 are arranged so as to sequentially contact one another in a direction orthogonal to the direction of a rotational axis of the developing sleeve 1.

Figure 4:
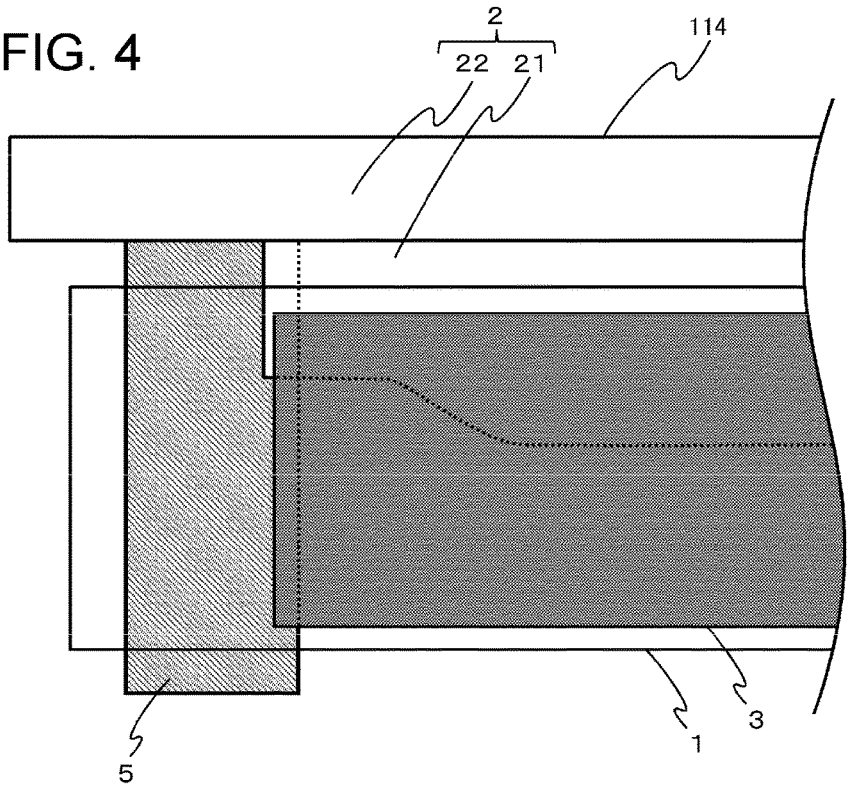
FIG. 4 is a schematic diagram depicting an end configuration of the developing unit according to Embodiment 1.
Figure 5:
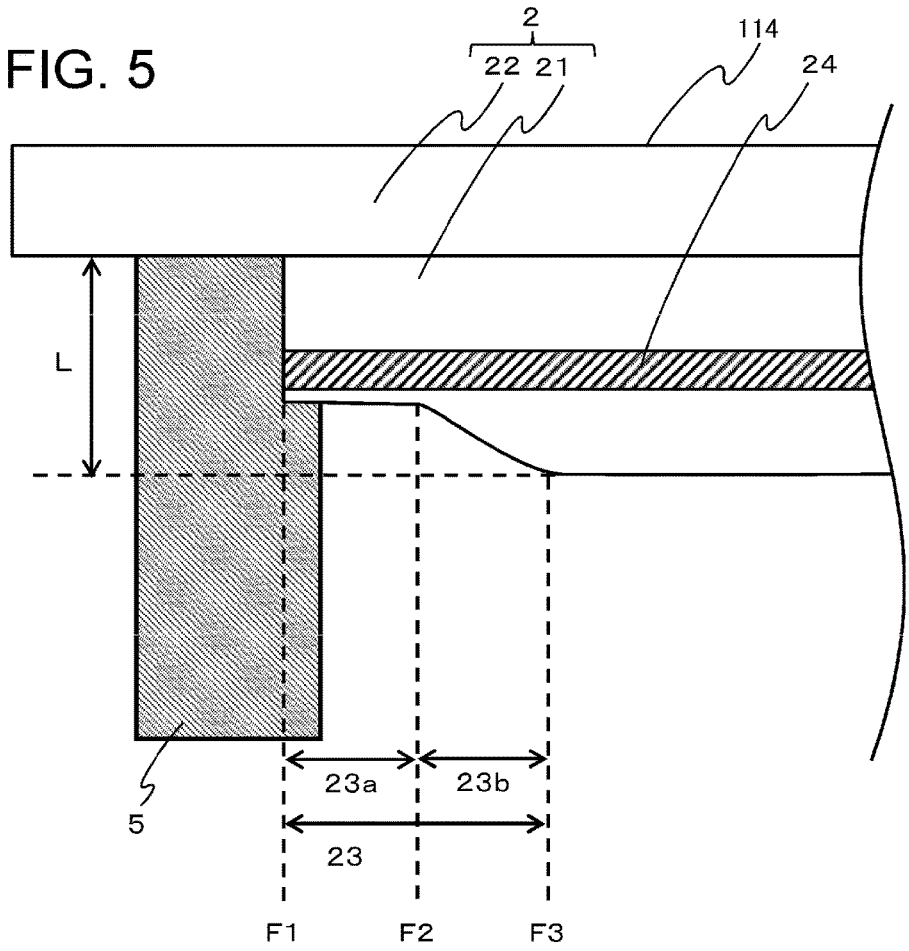
FIG. 5 is a schematic diagram depicting an end configuration of the developing unit according to Embodiment 1.

FIGS. 4 and 5 are schematic diagrams depicting an end configuration of the developing unit 114 in Embodiment 1. Compared to FIG. 4, FIG. 5 omits the developing sleeve 1 and the magnet roller 3 in order to illustrate the regulating blade 2 in detail. All the members other than the drive gear not depicted in the drawings are substantially symmetric in an axially lateral direction. Thus, only one end of each member is depicted, with the other end omitted. In FIGS. 4 and 5, a left side corresponds to an axially outer side, whereas a right side corresponds to an axially inner side. Vertical dashed lines F1, F2, and F3 represent axial positions. In regard to relations between the axial dimensions of the members, the flat rubber plate 21 of the regulating blade 2 overlaps the end seal 5 at each of the axially opposite ends of the developing unit 114. An axially outermost end of the flat rubber plate 21 is positioned in the middle of the end seal 5. The magnet roller 3 is also arranged to overlap the end seal 5.

The flat rubber plate 21 of the regulating blade 2 serves as a regulating member and has in the direction orthogonal to the axial direction a fixed end fixed to the frame 6 and a free end opposite to the fixed end. The flat rubber plate 21 further has a contact portion 24 located between the fixed end and the free end to contact the developing sleeve 1. That is, an area of the flat rubber plate 21 closer to a tip (free end) thereof than the contact portion 24 extends like eaves with respect to a peripheral surface of the developing sleeve 1, to form a space (toner take-in portion) with a generally wedge-shaped cross section between the peripheral surface of the developing sleeve 1 and the surface of the portion of the flat rubber plate 21 closer to the tip thereof than the contact portion 24. In the description below, a free length L is assumed for the length of the eaves, in other words, the distance between the free end of the flat rubber plate 21 and the fixed end of the flat rubber plate 21 in the direction orthogonal to the axial direction, in other words, the portion of the flat rubber plate 21 contacting the SUS sheet 22 and serving as a support when the flat rubber plate 21 is deformed.

The flat rubber plate 21 has short- and small-portions 23 formed at axially opposite ends of the flat rubber plate 21 and each having a smaller free length L than an axially central portion of the flat rubber plate 21. In other words, the flat rubber plate 21 has the short- and small-portions 23 at the axially opposite ends of the flat rubber plate 21 where the length from the contact portion 24 to the free end of the flat rubber plate 21 is smaller than at the axially central portion of the flat rubber plate 21. As a result, a force resulting from the contact between the flat rubber plate 21 and the developing sleeve 1 at the contact portion 24 of the overlap portion that overlaps the end seal 5 is weaker than in a case where the free length L is set equal to the corresponding length of the axially central portion of the flat rubber plate 21. As described above, the force resulting from the contact between the flat rubber plate 21 and the developing sleeve 1 is restrained from being increased at the overlap portion. Thus, at the contact portion 24, the flat rubber plate 21 and the developing sleeve 1 contact each other under a substantially uniform force all along the axial direction.

On the other hand, the free length L of the flat rubber plate 21, the length from the contact portion 24 to the free end, is smaller at the opposite ends than at the central portion of the flat rubber plate 21. This reduces the above-described take-in portion in size. In the present embodiment, a second area in the present invention corresponds to an end F1 of the flat rubber plate 21 to a central portion-side end F3 of the short- and small-portion. A first area in the present invention corresponds to an area from one end F3 to the other end F3 (not depicted in the drawings) including the axially central portion of the flat rubber plate 21. The short- and small-portion 23 is formed to extend into the overlap portion. At least in an area of the short- and small-portion 23 that overlaps the overlap portion, the length between the contact portion 24 and the free end is constant.

If the flat rubber plate 21 does not have the short- and small-portions and the relation between the axial dimensions is such that a large take-in portion is formed in the area where the flat rubber plate 21, the end seal 5, and the developing sleeve 1 overlap, then sealability may be deteriorated. That is, in the area of the flat rubber plate 21 that is closer to the tip of the flat rubber plate 21 than the contact portion 24, a gap (take-in portion) is formed between the flat rubber plate 21 and the peripheral surface of the developing sleeve 1. Damage to the seal area by the end seal 5 increases in proportion to an increase in the size of the gap overlapping the end seal 5. In that case, toner fails to be trapped that flows into the elastic sealing member 5 through the gap between the regulating blade 2 and the developing sleeve 1 at any time, possibly leading to leakage of the toner. Thus, preferably, the short- and small-portions 23 are provided at the axially opposite ends of the flat rubber plate 21 to minimize the gap between the peripheral surface of the developing sleeve 1 and the area of the flat rubber plate 21 that is closer to the tip of the flat rubber plate 21 than the contact portion 24, thus reducing the size of the gap that damages the seal area formed by the end seal 5.

Each of the short- and small-portions 23 has a flat portion 23*a* with the free length L unvaried in the axial direction and an inclined portion 23*b* with the free length L continuously varying. The flat portion 23*a* is positioned at the axially outermost end of the flat rubber plate 21. That is, the short- and small-portion 23 is configured such that the length between the contact portion 24 and the free end varies so as to vary the position of the free end in a direction inclined to the longitudinal direction toward the overlap portion from the side of the central portion. At the vertical dashed line F3, which is a boundary between the axially central portion with the large free length L and the inclined portion 23*b*, and the vertical dashed line F2, which is a boundary between the inclined portion 23*b* and the flat portion 23*a*, the tips of the flat rubber plate 21 are connected together with gentle circular arcs.

As described above, along the entire area of the flat rubber plate 21 in the axial direction including the short- and small-portions 23, the regulating blade 2 is in surface contact with the developing sleeve 1 at the contact portion 24. This is what is called a face contact configuration. The contact portion 24 is formed to have, along the entire area of the contact portion 24 in the axial direction, a constant width in a circumferential direction of the peripheral surface of the developing sleeve 1. If the regulating blade 2 is brought into edge contact with the developing sleeve 1 in the area where the regulating blade 2 overlaps the end seal 5, an increased contact pressure is exerted between the regulating blade 2 and the developing sleeve 1 as described above. Thus, toner may stick between the regulating blade 2 and the developing sleeve 1 to form a gap between the regulating blade 2 and the developing sleeve 1, leading to a high likelihood of leakage of the toner. Thus, even in the area where the regulating blade 2 overlaps the end seal 5, the regulating blade 2 preferably has a face contact configuration.

(Configuration of the Magnet Roller)

Figure 6:
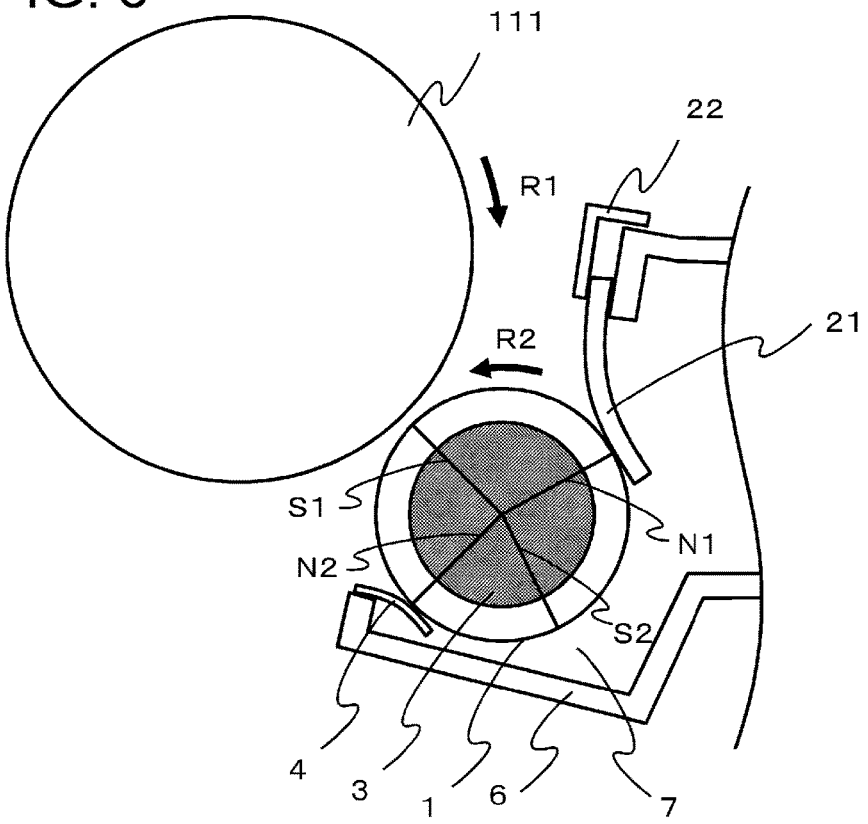
FIG. 6 is a schematic perspective view depicting a configuration of the developing unit according to Embodiment 1.

Using FIGS. 6 and 1, description will be given that relates to arrangement of magnet poles of the magnet roller 3 and the distribution of magnetic flux density in Embodiment 1. FIG. 6 is a schematic sectional view depicting a sectional configuration in the axial center of the developing unit 114 in Embodiment 1. In the axial center of the developing unit 114, the magnet roller 3 has four magnetic poles arranged along a circumferential direction of the magnet roller 3. The magnetic flux density in a normal direction exhibits peak values at a development pole S1, a regulation pole N1, a supply pole S2, and a collection pole N2. The magnet roller 3 is fixed as depicted in FIG. 6 (that is, the magnetic poles constantly remain arranged as depicted in FIG. 6). The developing sleeve 1 rotates around the magnet roller 3 (R2 direction) in conjunction with rotation of the photosensitive drum 111 (R1 direction).

The magnet poles are formed at the different positions so as to generate respective magnetic fields that exert the following effects on the toner in the present embodiment that is a magnetic developer. The development pole S1 is provided near a position where the developing sleeve 1 is in closest proximity to the photosensitive drum 111, to allow the toner to be carried on the developing sleeve 1 during development. The regulation pole N1 is provided near the contact position between the developing sleeve 1 and the regulating blade 2 to regulate the layer thickness of the toner on the developing sleeve 1. The supply pole S2 is provided at a position opposite to the developing opening 7 to allow the toner in the frame 6 to be carried and conveyed onto the developing sleeve 1. The collection pole N2 is provided near the contact position between the developing sleeve 1 and the blow-off preventing sheet 4 to prevent the toner from leaking through the gap between the developing sleeve 1 and the blow-off preventing sheet 4.

The polarities of the magnetic poles in the axial center are such that the development pole S1 and the supply pole S2 are S poles, whereas the regulation pole N1 and the collection pole N2 are N poles and such that the N poles and the S poles are alternately arranged in the circumferential direction. The magnetic developer in the present embodiment includes both one-component magnetic toner and a two-component developer containing a magnetic carrier and toner (pigment). The following references to the development pole S1, the regulation pole N1, the supply pole S2, and the collection pole N2 indicate circumferential positions in the axial center where the magnetic flux densities of the four magnetic poles exhibit peak values.

Figure 1:
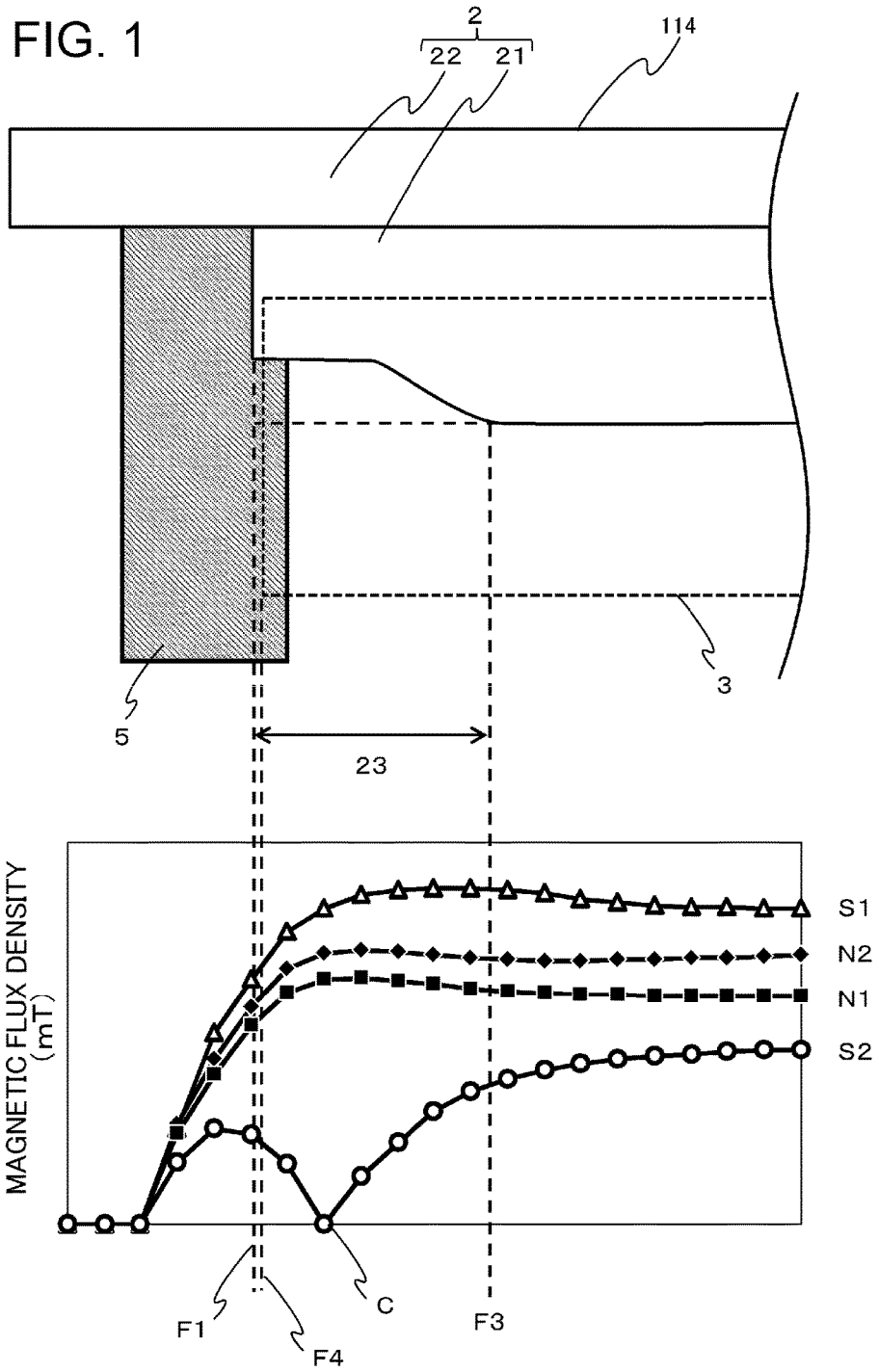
FIG. 1 is a schematic diagram depicting an end configuration of a developing unit according to Embodiment 1.

FIG. 1 is a schematic diagram and a graph illustrating the magnetic flux densities on the magnet roller 3 at the end of the developing unit 114. The graph illustrates the magnetic flux density in the normal direction at each of the four circumferential positions. Based on the vertical dashed lines F1, F3, and F4, the axial positions are associated with the axis of abscissas of the graph. The magnetic flux densities in the normal direction and the positional relations in the axial direction are substantially symmetric in the axially lateral direction, and thus, are illustrated only for one end and omitted for the other end.

The magnetic flux densities were measured by a method described below using a gauss meter (manufactured by F. W. Bell). First, a jig is prepared that allows the magnet roller 3 to rotate around an axis coinciding with the center of rotation of the developing sleeve 1. A measurement terminal of the gauss meter is fixedly installed at a position where the measurement terminal overlaps an outside diameter of the developing sleeve 1. At that time, the measurement terminal is directed toward the center of rotation of the magnet roller 3 to measure the magnetic flux densities in the normal direction. Then, the magnet roller 3 is rotated to a predetermined circumferential position, and then, the measurement terminal is moved in the axial direction to measure the magnetic flux density at predetermined axial positions. This operation is performed for each of the magnetic poles to measure the axial distribution of the normal magnetic flux density of the magnetic pole.

A vertical dashed line F4 is a line indicative of the axially outermost end position of the magnet roller 3. The development pole S1, the regulation pole N1, and the collection pole N2 are magnetized up to the outermost end of the magnet roller 3. The magnetic flux density in the normal direction gradually decreases outward in the axial direction from the vicinity of the vertical dashed line F4, which is the outermost end of the magnet roller 3. In that case, the magnet roller 3 is preferably arranged such that the development pole S1 maintains a predetermined magnetic flux density until a position outside the developing opening 7 is reached, that is, a longitudinal position where the end seal 5 is provided. This allows suppression of fly of the toner from the developing sleeve 1 to the photosensitive drum 111, that is, fogging.

In contrast, the supply pole S2 of the magnet roller 3 has a first area positioned in an axially central portion of the magnet roller 3 and having a predetermined magnetic flux density, and a second area having a inflection point C (local minimum portion) where the magnetic flux density in the normal direction is minimized. The second area is provided at each of the opposite ends of the first area. The inflection point C (minimum point) is positioned within the range from an end of the second area connected to the first area to an axially outer end of the overlap portion overlapping the end seal 5. In such a configuration, in the second area the magnetic flux density decreases from the axially central portion side connected to the first area to the inflection point C, but increases again from the inflection point C toward a further outer side. After reaching the maximum value, the magnetic flux density decreases again and reaches the minimum value (zero) at the axially outermost end. Consequently, magnetic forces act in the axially opposite directions with respect to the inflection point C. Then, the toner on the surface of the developing sleeve 1 carried at an axial position where the inflection point C is located is stripped away in the axially opposite directions. Thus, the inflection point C is arranged at the axial position corresponding to the short- and small-portion 23, that is, between the vertical dashed line F1 and the vertical dashed line F3. This makes the toner unlikely to stagnate between the regulating blade 2 and the developing sleeve 1 in the overlap portion. Therefore, toner leakage can be suppressed that results from sticking of the toner between the regulating blade 2 and the developing sleeve 1. Besides, in regard to facilitation of unwanted carriage of the toner on the short- and small-portion 23 as described above, the toner is stripped away in the axially opposite directions at the supply pole S2, and can thus be restrained from sticking.

A method for forming the inflection point C involves, for example, varying the intensity of magnetization in the axial direction. That is, the intensity of magnetization may be lower at a position slightly inward of the outermost end of the magnet roller 3 than at the outermost end and the axially central portion of the magnet roller 3.

An alternative method involves, for example, inhibiting only for the supply pole S2 the magnet roller 3 from being magnetized up to the outermost end thereof. In that case, for the supply pole S2, the magnetic flux density in the normal direction gradually decreases from the vicinity of a magnetized boundary portion toward the axial end. At the outermost end of the magnet roller 3, the magnetic pole of the supply pole S2 exerts no effect. On the other hand, at circumferentially opposite sides of the supply pole S2, the regulation pole N1 and the collection pole N2 are present, which have opposite polarities. Thus, due to the effects of the regulation pole N1 and the collection pole N2, the polarity of the supply pole S2 is switched between the polarities of the regulation pole N1 and the collection pole N2 at each outermost end of the magnet roller 3. At that time, the position where the polarity is switched between S and N corresponds to the inflection point C (in the axial magnetic flux density distribution in the phase of the supply pole S2 over a circumference of the developing sleeve 1, the polarity of the supply pole S2 is inverted at the inflection point C). Thus, the use of this method makes the magnetic flux density in the normal direction zero at the inflection point C.

An increase in the inclination at which the magnetic flux density in the normal direction varies in the axial direction correspondingly increases the magnetic force exerted to strip away, in the axially opposite directions, the toner carried on the surface of the developing sleeve 1. Thus, for the above-described two methods for forming the inflection point C, the method in which, only for the supply pole S2, the magnet roller 3 is inhibited from being magnetized up to the outermost end allows the toner to be more easily stripped away. That is, in this configuration, after decreasing to the minimum value, the magnetic flux density remains at that value until the overlap portion is reached instead of increasing again.

In the present embodiment, only the supply pole S2 exhibits the minimum magnetic flux density. However, the present invention is not limited to this configuration. Any other pole, a plurality of the poles, or all of the poles may have the minimum value.

Other Embodiments

Figure 7:
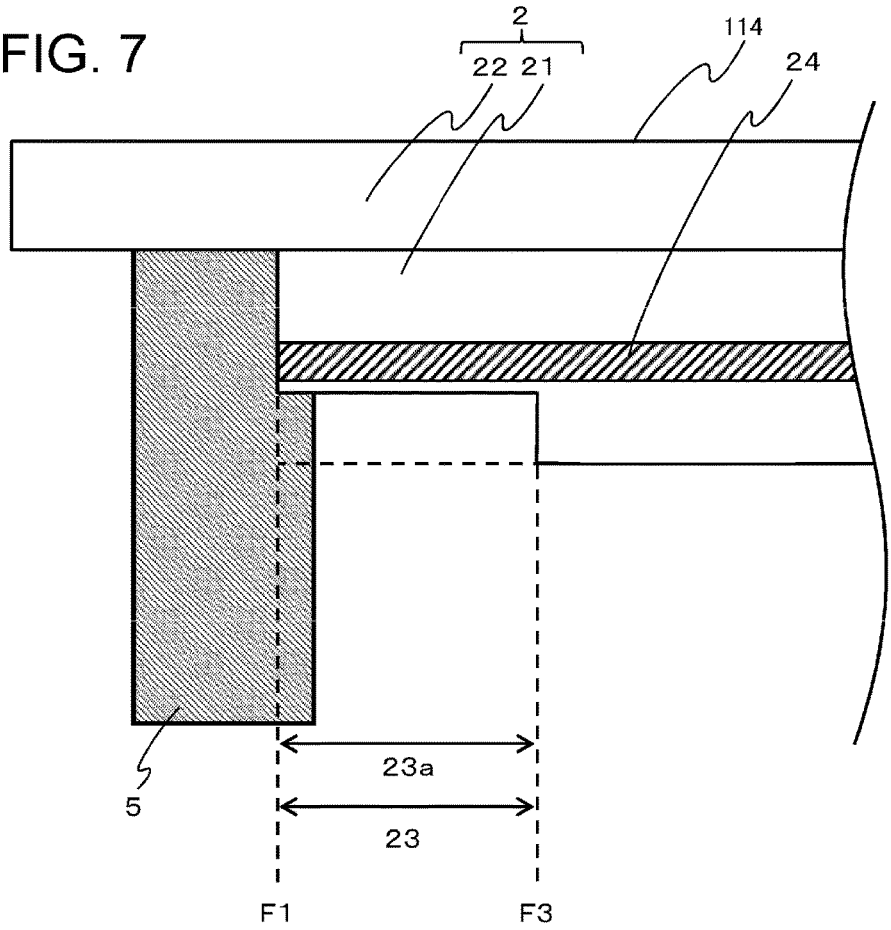
FIG. 7 is a schematic diagram depicting an end configuration of a developing unit according to Embodiment 2.
Figure 8:
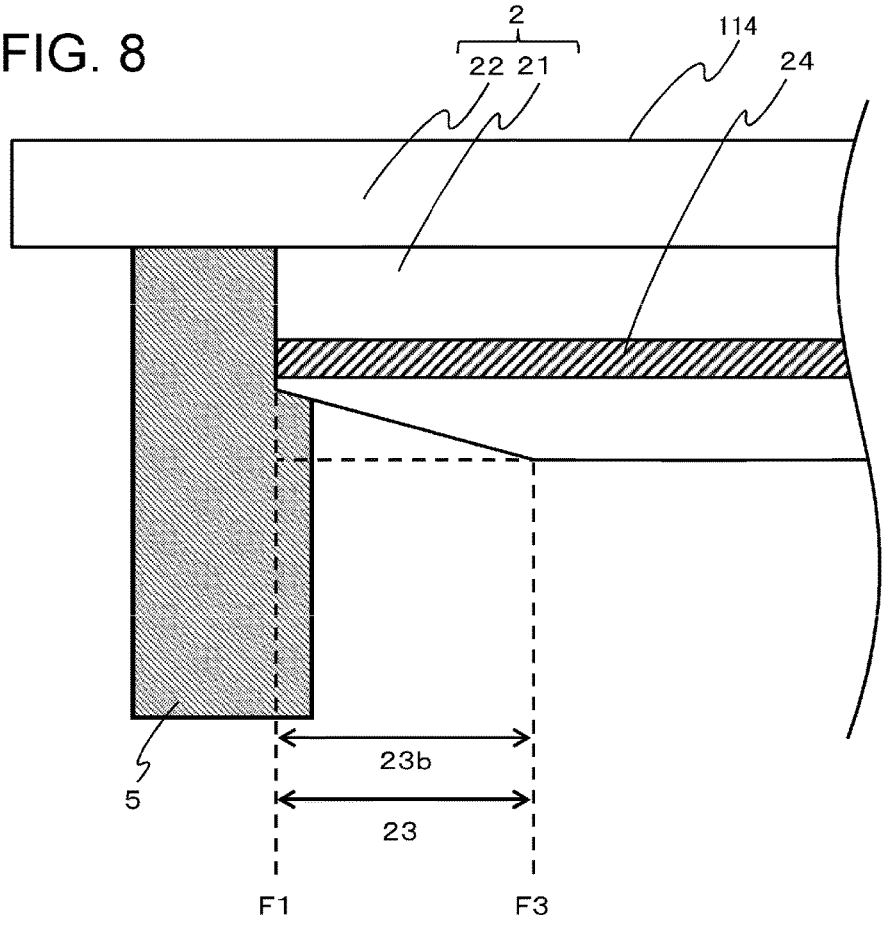
FIG. 8 is a schematic diagram depicting an end configuration of a developing unit according to Embodiment 3.
Figure 9:
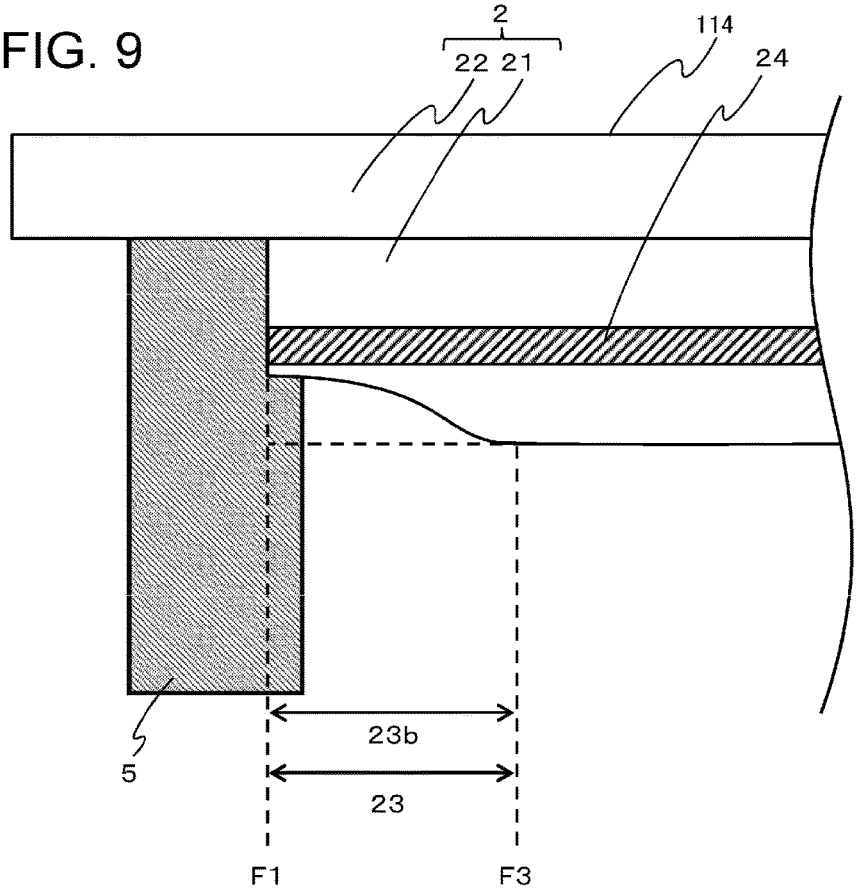
FIG. 9 is a schematic diagram depicting an end configuration of a developing unit according to Embodiment 4.

In Embodiment 1, the short- and small-portion 23 includes the flat portion 23*a* and the inclined portion 23*b*. In contrast, the short- and small-portion 23 may be formed exclusively of the flat portion 23*a*, for example, as depicted in a schematic diagram in FIG. 7 (Embodiment 2). In contrast, the short- and small-portion 23 may be formed exclusively of the inclined portion 23*b* as depicted in a schematic diagram in FIG. 8 (Embodiment 3). Moreover, the short- and small-portion 23 may be bent as depicted in a schematic diagram in FIG. 9 (Embodiment 4). Even in these cases, when the inflection point C where the supply pole S2 has the minimum magnetic flux density in the normal direction is provided at the axial position corresponding to the short- and small-portion 23, the toner can be restrained from sticking at the short- and small-portion 23.

Figure 10:
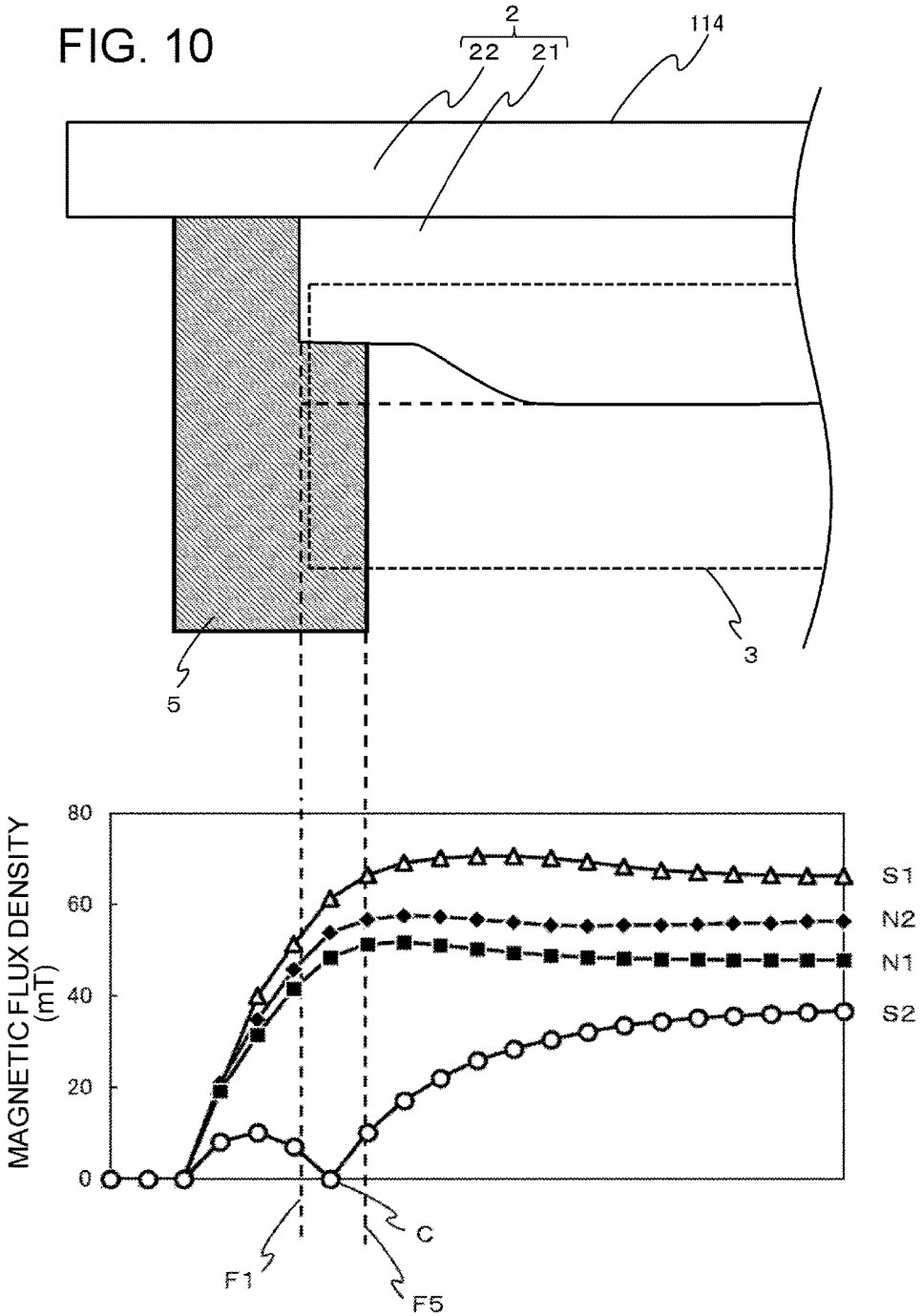
FIG. 10 is a schematic diagram depicting an end configuration of a developing unit according to Embodiment 5.

Furthermore, the inflection point C may be arranged in the overlap portion, that is, between the vertical dashed line F1 and a vertical dashed line F5 as depicted in a schematic diagram in FIG. 10 (Embodiment 5). In this case, the vertical dashed line F5 represents the position of the inner end of the end seal 5 in the axial direction. In such a configuration, the toner is stripped away at the supply pole S2 in the axially opposite directions to allow the toner accumulated on the surface of the developing sleeve 1 to flow between the end seal 5 and the developing sleeve 1 and to be restrained from sticking, as is the case with Embodiment 1. Components of the apparatus in Embodiments 2 to 5 that are not described here are similar to corresponding components in Embodiment 1 and will thus not be described.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-118241, filed Jun. 14, 2016, No. 2017-98292, filed May 17, 2017 which are hereby incorporated by reference herein in their entirety.

What is claimed is:

1. A developing apparatus comprising:

a container containing a magnetic developer and having an opening through which the magnetic developer is fed;

a developer bearing member provided in the container so as to be rotatable in the opening and configured to carry the magnetic developer;

a magnetic field generating member provided inside the developer bearing member to generate a predetermined magnetic field;

a regulating member configured to contact the developer bearing member to regulate a layer thickness of the magnetic developer carried on the developer bearing member; and a sealing member configured to seal a gap between an end of the developer bearing member in a rotation axis direction and an end of the opening in a longitudinal direction, wherein, at the end of the opening in the longitudinal direction, an overlap portion is provided in which the developer bearing member, the regulating member, the sealing member, and the container are sequentially arranged so as to contact one another in a direction orthogonal to the rotation axis direction, the magnetic field generating member has a first area where a value of a magnetic flux density is a predetermined value in the rotation axis direction and a second area including a local minimum portion in which the value is a minimum value, within a range from an end of the second area connected to the first area to an outer end of the overlap portion in the rotation axis direction, and wherein in the second area, from the first area toward the overlap portion, the value decreases to the minimum value and then increases again.

2. The developing apparatus according to claim 1, wherein in the second area, from the first area toward the overlap portion, the value decreases from the predetermined value to the minimum value and then remains at the minimum value to the outer end in the longitudinal direction.

3. The developing apparatus according to claim 1, wherein the magnetic field generating member has at least one magnetic pole, which is located on a surface of the developer bearing member in a circumferential direction and which has a peak value of the magnetic flux density in an area of the surface of the developer bearing member, which faces an inside of the container, and in a central portion of the area in the rotation axis direction.

4. The developing apparatus according to claim 1, wherein the regulating member has a fixed end fixed to the container, a free end opposite to the fixed end, and a contact portion located between the fixed end and the free end and in contact with the developer bearing member, and has a short- and small-portion which is located at the end in the rotation axis direction and at which a length between the contact portion and the free end is smaller than at a central portion in the rotation axis direction, and a position of the short- and small-portion overlaps a position of the second area in the rotation axis direction.

5. The developing apparatus according to claim 4, wherein with regard to the regulating member, the length between the contact portion and the free end is constant in the overlap portion.

6. The developing apparatus according to claim 4, wherein the contact portion is formed all over an area of the regulating member in the rotation axis direction.

7. The developing apparatus according to claim 4, wherein with regard to the local minimum portion, the length between the contact portion and the free end varies such that, from the central portion toward the overlap portion, a position of the free end varies in a direction inclined in the rotation axis direction.

8. An image forming apparatus comprising:

an image bearing member configured to bear a latent image; and the developing apparatus according to claim 1, wherein the developing apparatus develops the latent image to transfer a developer image formed on the image bearing member to a recording material thereby forming an image on the recording material.

9. A developing apparatus comprising:

a container containing a magnetic developer and having an opening through which the magnetic developer is fed;

a developer bearing member provided in the container so as to be rotatable in the opening and configured to carry the magnetic developer;

a magnetic field generating member provided inside the developer bearing member to generate a predetermined magnetic field;

a regulating member configured to contact the developer bearing member to regulate a layer thickness of the magnetic developer carried on the developer bearing member; and a sealing member configured to seal a gap between an end of the developer bearing member in a rotation axis direction and an end of the opening in a longitudinal direction, wherein, at the end of the opening in the longitudinal direction, an overlap portion is provided in which the developer bearing member, the regulating member, the sealing member, and the container are sequentially arranged so as to contact one another in a direction orthogonal to the rotation axis direction, the magnetic field generating member has a first area where a value of a magnetic flux density is a predetermined value in the rotation axis direction and a second area including a local minimum portion in which the value is a minimum value, within a range from an end of the second area connected to the first area to an outer end of the overlap portion in the rotation axis direction, and wherein the regulating member has a fixed end fixed to the container, a free end opposite to the fixed end, and a contact portion located between the fixed end and the free end and in contact with the developer bearing member, and has a short- and small-portion which is located at the end in the rotation axis direction and at which a length between the contact portion and the free end is smaller than at a central portion in the rotation axis direction, and a position of the short- and small-portion overlaps a position of the second area in the rotation axis direction.

10. The developing apparatus according to claim 9, wherein in the second area, from the first area toward the overlap portion, the value decreases to the minimum value and then increases again.

11. The developing apparatus according to claim 9, wherein in the second area, from the first area toward the overlap portion, the value decreases from the predetermined value to the minimum value and then remains at the minimum value to the outer end in the longitudinal direction.

12. The developing apparatus according to claim 9, wherein the magnetic field generating member has at least one magnetic pole, which is located on a surface of the developer bearing member in a circumferential direction and which has a peak value of the magnetic flux density in an area of the surface of the developer bearing member, which faces an inside of the container, and in a central portion of the area in the rotation axis direction.

13. The developing apparatus according to claim 9, wherein with regard to the local minimum portion, the length between the contact portion and the free end varies such that, from the central portion toward the overlap portion, a position of the free end varies in a direction inclined in the rotation axis direction.

14. An image forming apparatus comprising:

an image bearing member configured to bear a latent image; and the developing apparatus according to claim 9, wherein the developing apparatus develops the latent image to transfer a developer image formed on the image bearing member to a recording material thereby forming an image on the recording material.

15. A developing apparatus comprising:

a container containing a magnetic developer and having an opening through which the magnetic developer is fed;

a developer bearing member provided in the container so as to be rotatable in the opening and configured to carry the magnetic developer;

a magnetic field generating member provided inside the developer bearing member to generate a predetermined magnetic field;

a regulating member configured to contact the developer bearing member to regulate a layer thickness of the magnetic developer carried on the developer bearing member; and a sealing member configured to seal a gap between an end of the developer bearing member in a rotation axis direction and an end of the opening in a longitudinal direction, wherein, at the end of the opening in the longitudinal direction, an overlap portion is provided in which the developer bearing member, the regulating member, the sealing member, and the container are sequentially arranged so as to contact one another in a direction orthogonal to the rotation axis direction, and the magnetic field generating member has a first area where a value of a magnetic flux density is a predetermined value in the rotation axis direction and a second area including a local minimum portion in which the value is a minimum value, within a range from an end of the second area connected to the first area to an outer end of the overlap portion in the rotation axis direction, the minimum portion being arranged inside of the sealing member in the rotation axis direction.

16. The developing apparatus according to claim 15, wherein in the second area, from the first area toward the overlap portion, the value decreases to the minimum value and then increases again.

17. The developing apparatus according to claim 15, wherein in the second area, from the first area toward the overlap portion, the value decreases from the predetermined value to the minimum value and then remains at the minimum value to the outer end in the longitudinal direction.

18. The developing apparatus according to claim 15, wherein the magnetic field generating member has at least one magnetic pole, which is located on a surface of the developer bearing member in a circumferential direction and which has a peak value of the magnetic flux density in an area of the surface of the developer bearing member, which faces an inside of the container, and in a central portion of the area in the rotation axis direction.

19. The developing apparatus according to claim 15, wherein the regulating member has a fixed end fixed to the container, a free end opposite to the fixed end, and a contact portion located between the fixed end and the free end and in contact with the developer bearing member, and has a short- and small-portion which is located at the end in the rotation axis direction and at which a length between the contact portion and the free end is smaller than at a central portion in the rotation axis direction, and a position of the short- and small-portion overlaps a position of the second area in the rotation axis direction.

20. An image forming apparatus comprising:

an image bearing member configured to bear a latent image; and the developing apparatus according to claim 15, wherein the developing apparatus develops the latent image to transfer a developer image formed on the image bearing member to a recording material thereby forming an image on the recording material.

* * * * *